United States Patent [19]

Hobbs

[11] Patent Number: 4,998,828

[45] Date of Patent: Mar. 12, 1991

[54] OVER AND UNDER TELESCOPING SLIDE ASSEMBLY

[75] Inventor: James D. Hobbs, Plainfield, Ind.

[73] Assignee: General Devices Co., Inc., Indianapolis, Ind.

[21] Appl. No.: 416,054

[22] Filed: Oct. 2, 1989

[51] Int. Cl.[5] ..... A47B 88/16

[52] U.S. Cl. ..... 384/18; 384/21; 312/348

[58] Field of Search ..... 384/18, 19, 20, 21, 384/22, 23; 312/333, 334, 338, 338, 348

[56] References Cited

U.S. PATENT DOCUMENTS

| | | | |
|---|---|---|---|
| 3,488,097 | 1/1970 | Fall | 312/339 X |
| 3,771,849 | 11/1973 | Barber . | |
| 3,901,564 | 8/1974 | Armstrong | 312/333 X |
| 3,923,347 | 12/1975 | Dean | 384/21 |
| 4,200,342 | 4/1980 | Fall . | |
| 4,272,139 | 6/1981 | Fler | 312/333 X |
| 4,370,007 | 1/1983 | Fler | 312/333 X |
| 4,423,914 | 1/1984 | Vander Ley | 312/333 |
| 4,469,384 | 9/1984 | Fler et al. | 312/333 |
| 4,473,262 | 9/1984 | Staye | 312/333 |
| 4,549,773 | 10/1985 | Papp et al. | 384/18 |
| 4,560,212 | 12/1985 | Papp et al. | 384/18 |
| 4,662,761 | 5/1987 | Hoffman | 384/18 |
| 4,679,950 | 7/1987 | Delmege et al. . | |
| 4,872,734 | 10/1989 | Rechberg | 384/19 X |

OTHER PUBLICATIONS

One sheet of drawing, Accuride Model Number 447, "Three Member, Full Extension, Drawer Rail Disconnect", Jun. 15, 1978.

*Primary Examiner*—Daniel P. Stodola
*Assistant Examiner*—Battista, Jr. William G.
*Attorney, Agent, or Firm*—Barnes & Thornburg

[57] ABSTRACT

A telescoping assembly includes a drawer slide member that is slidable toward its retracted position to unlock a trigger lever interconnecting intermediate and cabinet slide members, thereby permitting relative movement between the intermediate and cabinet slide members. Otherwise, the trigger lever acts to block rearward movement of the intermediate slide member toward its retracted position relative to the stationary cabinet member.

2 Claims, 2 Drawing Sheets

OVER AND UNDER TELESCOPING SLIDE ASSEMBLY

BACKGROUND AND SUMMARY OF THE INVENTION

This invention relates to drawer slide hardware, and particularly to an over and under telescoping slide assembly provided with a ball bearing slide mechanism. More particularly, this invention relates to a disconnectable over and under telescoping slide assembly having a drawer slide member that is slidable toward a retracted position to break a locked connection retaining an intermediate slide member in a partly extended position with respect to a stationary cabinet slide member.

A telescoping slide assembly is mounted in a cabinet to support a drawer or chassis for movement between a retracted position inside the cabinet and an extended position projecting outside of the cabinet. In most instances, a telescoping slide assembly includes at least three slide members. The first slide member is a stationary unit fixed to a cabinet and the second slide member is an intermediate unit extensible within limits from the stationary unit. The third slide member is extensible within limits from the intermediate unit and is the unit to which a drawer or electronic chassis is attached. In an "over and under" slide assembly, the third slide member is slidable along a path above the first slide member, whereas, in a "side by side" slide assembly, the third slide member is slidable along a path provided along the side of the first slide member.

One object of the present invention is to provide a telescoping slide assembly having a drawer slide member that is slidable along a path relative to the intermediate slide member to unlock a locking mechanism blocking relative movement of the intermediate slide member and the cabinet slide member so that the intermediate slide member is unlocked and movable from a partly extended position projecting away from the cabinet slide member to a retracted position alongside the stationary cabinet slide member.

Another object of the present invention is to provide a locking mechanism that is configured to block relative movement of the intermediate slide member and the cabinet slide member in order to retain the intermediate slide member in a partly extended position and that is positioned on the intermediate slide member to be engaged by the drawer slide member as it slides relative to the intermediate slide member to a retracted position. Advantageously, the locking mechanism is moved to an unlocked position by the moving drawer slide member so that the intermediate slide member is free to move relative to the fixed cabinet slide member.

Yet another object of the present invention is to provide an easily disconnectable drawer slide member suitable for use in an over and under telescoping slide assembly.

A further object of the present invention is to provide an over and under telescoping slide assembly having a drawer slide member that can be disconnected from an intermediate slide member of the slide assembly by sliding the drawer slide member until it disengages the intermediate slide member so that a drawer or chassis mounted on the drawer slide member can be removed quickly and easily from a cabinet in which the slide assembly is mounted.

Another object of the present invention is to provide an over and under telescoping slide assembly having a drawer slide member that slides in an intermediate slide member to disconnect the drawer slide member from the intermediate slide member and also to reinstall the drawer slide member in the intermediate slide member.

Still another object of the present invention is to provide an over and under telescoping slide assembly having a drawer slide member that is slidable on ball bearings retained in an intermediate slide member of the slide assembly to a position disengaging the intermediate slide member so that the drawer slide member can be disconnected from the intermediate slide member while the ball bearings are retained in the intermediate slide member.

According to the present invention, a telescoping slide assembly is provided for supporting a movable drawer in a cabinet. The slide assembly includes a stationary cabinet slide member for mounting on the cabinet, a drawer slide member for carrying the drawer, and an intermediate slide member. The intermediate slide member includes a support bracket slidably connected to the cabinet slide member and an outer section fixed to the support bracket for movement therewith. The outer section is formed to include channel means for receiving the drawer slide member therein.

Supporting means is retained in the channel means for slidably supporting the drawer slide member in the channel means. The drawer slide member is slidable relative to the outer section from a retracted position in the outer section to a release position disengaging the outer section. In operation, the drawer slide member and a drawer mounted thereon is slidably disconnected from the outer section of the intermediate slide member without removing the supporting means from the channel means of the outer section as soon as the sliding drawer slide member exits from the channel means of the outer section at the release position.

In preferred embodiments, the supporting means includes a bearing race containing a plurality of ball bearings arranged to engage both of the outer section and the drawer slide member. These ball bearings roll freely in the channel means formed in the outer section as the drawer slide member is extended and retracted with respect to the outer section.

The supporting means also includes means for retaining the bearing race and its ball bearings in the channel means upon disengagement of the drawer slide member and the outer section at the release position. The retaining means includes at least one stop lug mounted on the outer section and positioned to engage the bearing race during movement of the drawer slide member toward its release Position disengaging the outer section. The stop lugs block further movement of the bearing race so that the ball bearings supporting the drawer slide member remain with the race in the outer section of the intermediate slide member following disengagement of the drawer slide member and the outer section.

The telescoping slide assembly further includes a locking lug on the cabinet slide member, a trigger lever including a hook arm and an actuator arm, and means for pivotably coupling the trigger lever to the intermediate slide member for movement between locked and unlocked positions. In the locked position, the hook arm is placed in engagement with the locking lug to block movement of the intermediate slide member relative to the cabinet slide member from a partly extended position toward a fully retracted position. In the unlocked position, the hook arm and the locking lug are disengaged to permit movement of the intermediate slide member toward the fully retracted position.

The telescoping slide assembly further includes spring means for yieldably biasing the trigger lever to its locked position so that the hook arm is arranged to engage the locking lug upon movement of the intermediate slide member to the partly extended position. The actuator arm of the trigger lever is positioned by the coupling means to lie in the path of the drawer slide member as the drawer slide member reciprocates in the channel means.

In operation, the drawer slide member is movable relative to the intermediate slide member to contact the actuator arm. The drawer slide member is movable in the same direction a further amount against the actuator arm to pivot the trigger lever from its locked position to its unlocked position so that the intermediate slide member is movable relative to the cabinet slide member from its partly extended position toward its fully retracted position. The drawer slide member acts to retain the trigger lever in its unlocked position as long as the drawer slide member remains in its fully retracted position with respect to the intermediate slide member.

One feature of the present invention is provision of a drawer slide member that slidably engages an intermediate slide member to establish connection of the drawer slide member to a telescoping slide assembly mounted in a cabinet. Advantageously, the drawer slide member in accordance with the present invention is easily incorporated into an over and under slide so that a drawer or chassis mounted on the slidable drawer slide member can be removed from the cabinet by sliding the drawer side member until it disengages the tracks provided in the outer section of the intermediate slide member. In addition, the drawer can be reinstalled in the cabinet simply by inserting each drawer slide member mounted onto the drawer into the open end of a companion outer section mounted on the intermediate slide members to establish sliding engagement of the drawer slide member and the intermediate slide member.

A telescoping slide assembly having a drawer slide member that is slidably engageable and disengageable from an intermediate slide member is an improvement over known telescoping slide assemblies having a drawer shelf that is configured to be lifted off an underlying drawer slide member to disconnect a drawer or chassis mounted on the drawer shelf from the rest of the slide assembly. It has been observed that such "lift off" shelves are difficult to remove and remount in practice. Further, lift-off shelves are typically made of thin material so that they are fragile and easily damaged during shipment and actual operation.

Another feature of the present invention is the provision of supporting means retained in the channel means of the intermediate slide member for slidably supporting the drawer slide member in the channel means. Advantageously, the drawer slide member is completely removable from sliding engagement with the outer section of the intermediate slide assembly without removing any of the drawer slide member-supporting bearing means from the channel means. It has been observed that bearing means, especially ball bearings covered with a coating of grease, can become contaminated if removed from the intermediate slide member upon disconnection of the drawer slide member from the rest of a telescoping slide assembly. Further, it is oftentimes difficult to install a drawer slide member on an intermediate slide member if ball bearings are carried by the drawer slide member.

Yet another feature of the present invention is the provision of a telescoping slide assembly having a drawer slide member that is slidable toward its retracted position to unlock a trigger lever interconnecting intermediate and cabinet slide members. Otherwise, the trigger lever acts to block rearward movement of the intermediate slide member toward its retracted position relative to the stationary cabinet member. This represents an improvement over conventional manually actuated slide member-locking mechanisms which must necessarily be situated in a position on a telescoping slide assembly that is accessible to a user at the proper time.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2, 3, 4, 5, 6, 7, 8:
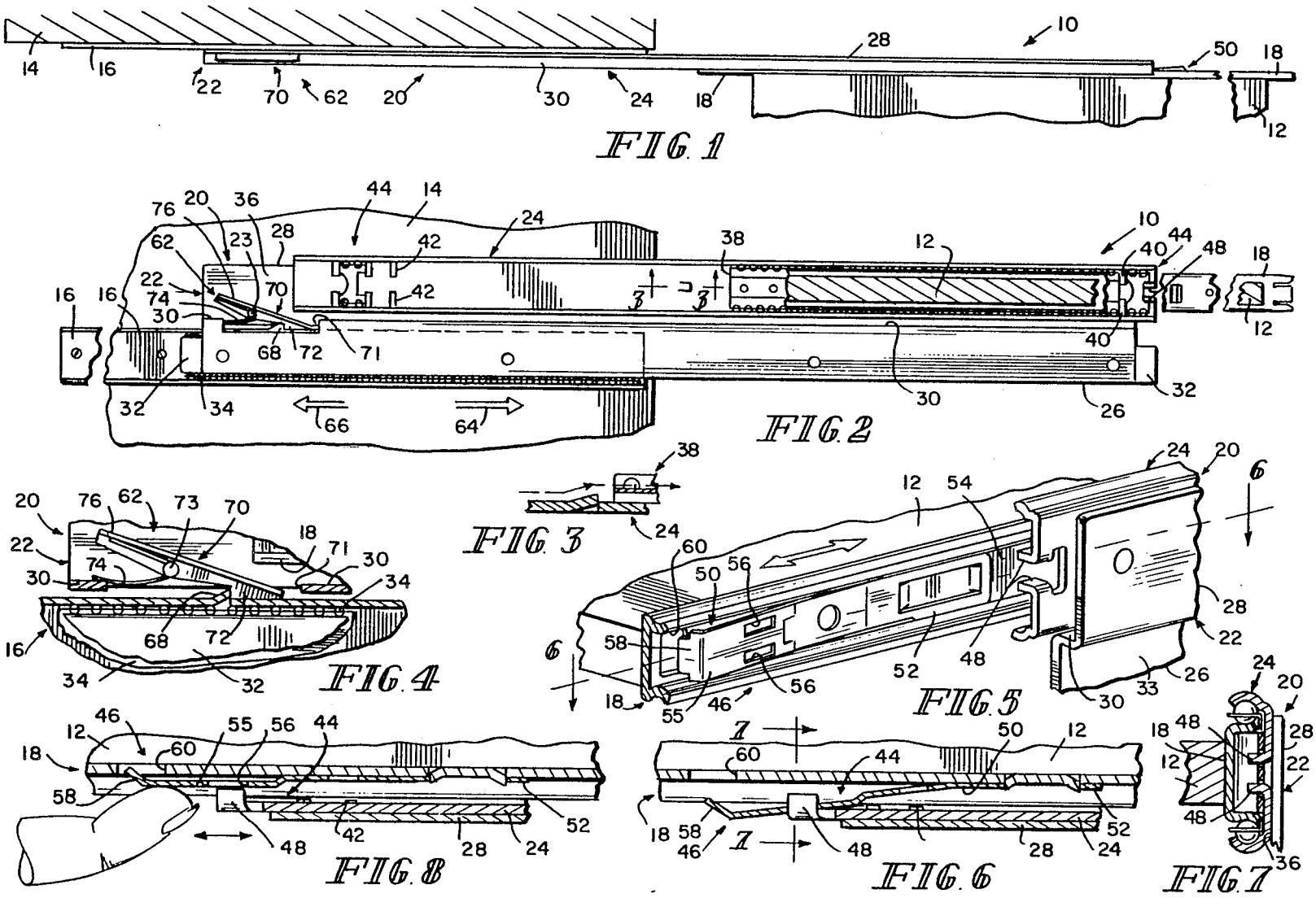
FIG. 1 is a top plan view of a telescoping slide assembly in accordance with the present invention showing a cabinet slide member mounted on a cabinet and a drawer mounted on a drawer slide member positioned between its partly extended position and its release position.
FIG. 2 is a side elevation view of the slide assembly of FIG. 1 showing the drawer slide member supported for sliding movement by the bearing race received in a channel Provided in an outer section of the intermediate slide member and a trigger lever mounted on the intermediate slide member to interlock the intermediate and cabinet slide members.
FIG. 3 is an enlarged sectional view taken along lines 3—3 of FIG. 2 showing a ramp provided on the outer section for camming a flexible strip on the drawer slide member onto the bearing race.
FIG. 4 is an enlarged view of the trigger lever assembly illustrated in FIG. 2 showing the trigger lever spring-biased to its locking position placing its hook arm in engagement with a locking lug on the cabinet slide member and its actuator arm in the path of the oncoming drawer slide member.
FIG. 5 is an enlarged perspective view of the slide assembly of FIG. 1 showing a pair of locking lugs on the distal end of the outer section of the intermediate slide member and a flexible strip mounted to the drawer slide member and formed to include lug-receiving apertures.
FIG. 6 is a sectional view taken generally along lines 6—6 of FIG. 5 after movement of the drawer slide member relative to the intermediate slide member showing engagement of the locking lugs and the flexible strip to establish locking engagement of the drawer slide member and the intermediate slide member upon movement of the drawer slide member to its partly extended position.
FIG. 7 is a sectional view taken along lines 7—7 of FIG. 6.
FIG. 8 is a view similar to FIG. 6 showing manual depression of the flexible strip to disengage the flexible strip and the locking lugs to permit relative movement of the drawer slide member and the intermediate slide member.

Referring to FIGS. 1 and 2, a telescoping slide assembly 10 is provided for supporting a movable drawer 12 in a cabinet 14. The slide assembly 10 includes a stationary cabinet slide member 16 mounted on the cabinet 14, a drawer slide member 18 for carrying the drawer 12, and an intermediate slide member 20 including a support bracket 22 slidably connected to the cabinet slide member 16 and an outer section 24 fixed to the support bracket 22 for movement therewith.

The support bracket 22 is a one-piece metal stamping including a pair of rectangular mounting plates 26, 28 interconnected by a longitudinally extending offset plate 30 as shown best in FIGS. 2 and 5. A lower elongated C-shaped channel section 32 is mounted on a cabinet-facing side 33 of lower mounting plate 26 to lie underneath offset plate 30. Channel section 32 is supported for sliding movement in the stationary cabinet slide member 16 by a bearing race assembly 34 that is slidable in the cabinet slide member 16. The outer section 24 is also an elongated C-shaped channel section that is mounted on a drawer-facing side 36 of upper mounting plate 28 to lie above offset plate 30.

The outer section 24 is formed to include a channel for receiving the drawer slide member 18 therein. A bearing race assembly 38 iS retained in the channel of outer section 24 for slidably supporting the drawer slide member 18 in the channel. The drawer slide member 18 is slidable in the channel relative to the outer section 24 from a retracted position in the outer section 24 (shown in FIG. 10) to a release position disengaging the outer section 24. Thus, the drawer slide member 18 and a drawer 12 mounted thereon is disconnected from the outer section 24 of the intermediate slide member 20 without removing the bearing race assembly 38 from the outer section channel in response to exit of the drawer slide member 18 from the outer section at the release position.

The bearing race assembly 38 contains a plurality of ball bearings arranged to engage both of the outer section 24 and the drawer slide member 18. These ball bearings roll freely as the drawer slide member 18 is extended and retracted with respect to the outer section 24. A pair of forward stop lugs 40 are mounted on the outer section 24 and positioned to engage the bearing race assembly 38 during movement of the drawer slide member 18 toward its release position disengaging the outer section 24 so that the ball bearings supporting the drawer slide member 18 remain in the outer section 24 following disengagement of the drawer slide member 18 and the outer section 24. Another pair of rearward stop lugs 42 are provided at the opposite end of outer section 24 to block movement of the bearing race assembly 38 during retraction of the drawer slide member 18.

Essentially, outer section 24 is an elongated member of substantially C-shaped transverse cross section having first and second ends and a pair of spaced-apart parallel tracks extending therebetween. These tracks provide means engaging the ball bearings for guiding the bearing race assembly 38 along a straight path through the outer section channel so that the bearing race assembly 38 is able to reciprocate in the outer section 24.

The rearward stop lugs 42 are mounted on the outer section 24 adjacent to the first end and positioned to engage the bearing race 38 upon arrival of the drawer slide member 18 at its retracted position. Rearward stop lugs 42 block further movement of the drawer slide member 18 toward the first end of the outer section 24.

The forward stop lugs 40 are mounted on the outer section 24 adjacent to the second end and positioned to engage the bearing race 38 during movement of the drawer slide member 18 toward its release position disengaging the outer section 24. The ball bearings supporting the drawer slide member 18 remain in the outer section 24 of the intermediate slide member 20 following disengagement of the drawer slide member 18 and the outer section 24 because escape of bearing race 38 from outer section 24 is blocked by forward stop lugs 40.

An auxiliary bearing race 44 is fixed to the outer section 24 to lie in a space provided between the first end and the rearward stop lugs 42 and the second end and the forward stop lugs 40. Auxiliary bearing race 44 serves to guide the drawer slide member 18 as it slides in the channel formed in the outer section 24.

A spring lock assembly 46 is mounted on the drawer slide member 18 for engaging the outer section 24 during relative movement of the drawer slide member 18 and the outer section 24 to establish a locked connection therebetween. The drawer slide member 18 is retained in a partly extended position with respect to the intermediate slide member 20 following engagement of spring locking assembly 46 and outer section 24 as shown best in FIGS. 1, 2, 6, and 7.

The outer section 24 includes a pair of locking lugs 48 and the spring lock assembly 46 includes a flexible strip 50 of spring material having a proximal portion 52 connected to a bottom wall 54 of the drawer slide member 18 and a distal portion 55. Distal portion 55 is formed to include a pair of apertures 56 for receiving the locking lugs 48 therein upon arrival of the drawer slide member 18 at the partly extended position.

The flexible strip 50 further includes a tab 58 connected to the distal portion 55 of the flexible strip 50 to lie normally in spaced-apart relation to the bottom wall 54 of the outer section 24 as shown in FIG. 6. The tab 58 is movable toward the bottom wall 54 against a bias force provided by the flexible strip 50 to enter a tab-receiving aperture 60 formed in the bottom wall 54. As a result, the distal portion 55 is moved as shown in FIG. 8 to a position releasing the locking lugs 48 from engagement in the apertures 56 so that the drawer slide member 18 is movable relative to the outer section 24 from its partly extended position toward its release position.

A blocking assembly (not shown) is mounted on the cabinet slide member 16 for blocking sliding movement of the intermediate slide member 20 relative to the cabinet slide member 16 in a forward direction 64 beyond the position shown in FIGS. 1 and 2. This blocking assembly acts to prevent disconnection of the intermediate slide member 20 from the cabinet slide member 16 during movement of the intermediate slide member 20 to a partly extended position with respect to the cabinet slide member 16.

In addition, a slide locking connector 62 is provided on the intermediate slide member 20 as shown in FIGS. 1, 2, and 4 for engaging the cabinet slide member 16 upon movement of the intermediate slide member 20 to its partly extended position Connector 62 blocks sliding movement of the intermediate slide member 20 in a rearward direction 66 opposite to the forward direction 64 so that a locked connection is established between the intermediate and cabinet slide member 24, 16 to retain the intermediate slide member 20 in the partly extended position.

The slide-locking connector 62 includes a locking lug 68 projecting upwardly from the cabinet slide member 16 toward the outer section 24 and a trigger lever 70 as shown best in FIGS. 2 and 4. As seen in FIGS. 2 and 4, the support bracket 22 is formed to include a longitudinally extending aperture 71 having an opening in offset plate 30 and an upper portion of lower mounting plate 26 adjacent to offset plate 30. Aperture 71 is situated to permit trigger lever 70 to extend through support bracket 20 and engage locking lug 68.

The trigger lever 70 includes a hook 72 and a pin 73 for pivotably coupling the trigger lever 70 to the intermediate slide member 20. The trigger lever 78 is able to pivot about pin 73 between locked and unlocked positions. In the locked position, the hook 72 of trigger lever 70 is placed in engagement with the locking lug 68 to block movement of the intermediate slide member 20 relative to the cabinet slide member 16 from a partly extended position toward a fully retracted position. In the unlocked position, the hook 72 is disengaged from the locking lug 68 to permit movement of the intermediate slide member 20 toward the fully retracted position. A spring 74 is provided for yieldably biasing the trigger lever 70 to its locked position so that the hook 72 is arranged to engage the locking lug 68 upon movement of the intermediate slide member 20 to the partly extended position.

The trigger lever 70 is positioned by the pivot pin 73 to lie in the path of the drawer slide member 18 as it reciprocates in the outer section channel. The drawer slide member 18 is movable relative to the intermediate slide member 20 to contact the trigger lever 70 and pivot the trigger lever 70 from its locked position to its unlocked position to permit the intermediate slide member 20 to move relative to the cabinet slide member 16 from its partly extended position toward its fully retracted position.

Figure 9:
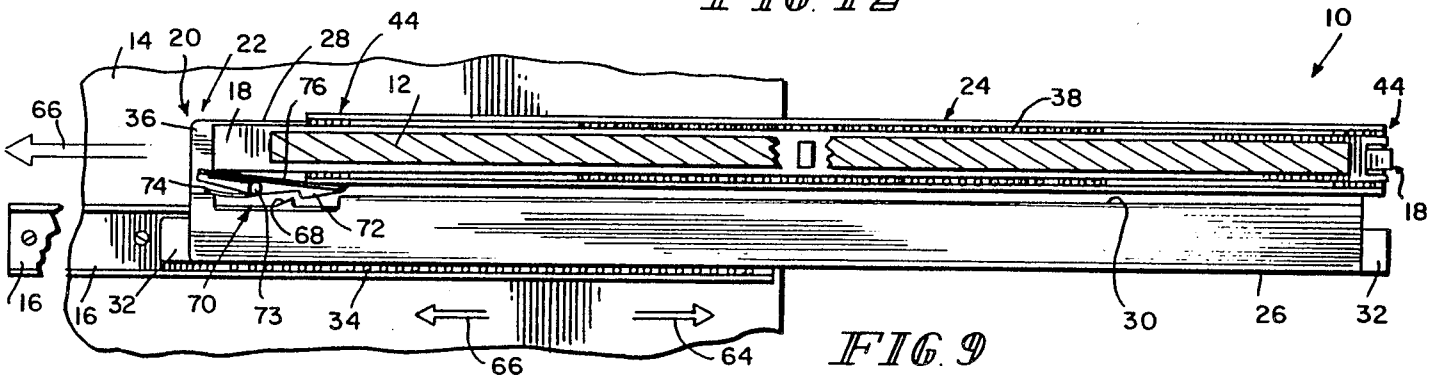
FIG. 9 is a side elevation view similar to FIG. 2 showing movement of the drawer slide member relative to the intermediate slide member to a position retaining the trigger lever in its unlocked position.
Figure 10:
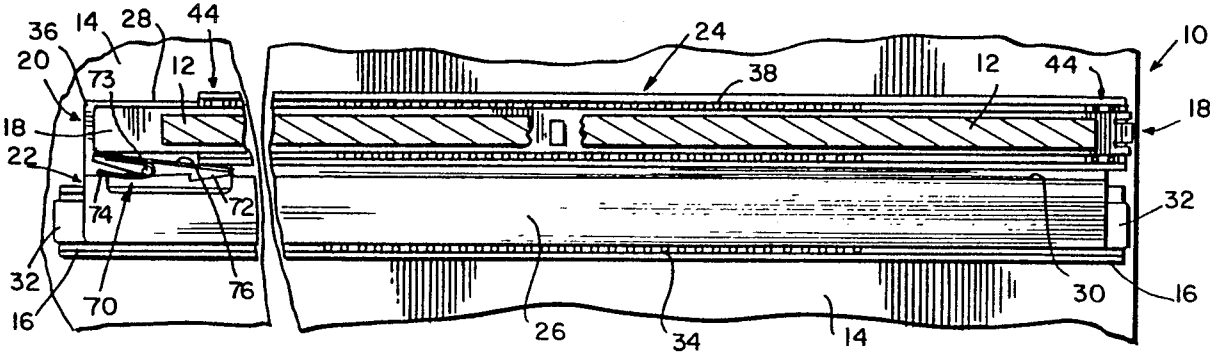
FIG. 10 is a side elevation view similar to FIGS. 2 and 9 showing the telescoping assembly after each of the intermediate and drawer slide members is moved to its retracted position.

The operation of trigger lever 70 during inward and outward movement of intermediate slide member 20 relative to stationary cabinet slide member 16 is best seen in FIGS. 10, 9, and 2. The telescoping slide assembly 10 is shown in its fully retracted position within cabinet 14 in FIG. 10. In this position, the rear end of drawer slide member 18 operates to pivot trigger lever 70 about pin 73 fixed to support bracket 22 and against the bias of spring 74 to its unlocked position. Hook 72 on trigger lever 70 is thus moved away from cabinet slide member 16 to disengage locking lug 68 formed thereon. It will be appreciated that drawer slide member 18 will act to hold or retain the trigger lever 70 in its unlocked position as long as the drawer slide member 18 is not moved relative to the intermediate slide member 20. A user is always able to pull a closed drawer 12 out of cabinet 14 because the drawer slide member 18 operates to block locking engagement of the cabinet and intermediate slide members 16, 20 while the drawer slide member 18 is pushed to its fully retracted position inside cabinet 14.

A first stage of movement of the intermediate and drawer slide member assembly 20, 18 relative to the stationary cabinet slide member 16 is illustrated in FIG. 9. At this stage, the drawer slide member 18 has not moved relative to intermediate slide member 20 sufficiently to release trigger lever 70 so that it may pivot about pin 73 to its locking position. Movement of intermediate slide member 20 in direction 64 will continue until slide member 20 is blocked by engagement with the blocking assembly (not shown) mounted on the cabinet slide member 16. At this point, the drawer slide member 18 will continue to move in direction 64 and begin to move relative to the now-stationary intermediate slide member 20. Such continued movement will cause the drawer slide member 18 to disengage a top cam face 76 of trigger lever 70 as shown in FIG. 2.

Spring 74 now operates against the offset plate 30 on which one of its legs rests to pivot trigger lever 70 to its locking position shown in FIGS. 2 and 4. Now the hook 72 will engage locking lug 68 to block movement of intermediate slide member 20 in direction 66 relative to stationary cabinet slide member 16. The intermediate slide member 20 will remain locked in this position until the drawer 12 is later closed causing drawer slide member 18 to move into cabinet 14 in direction 66 past the position shown in FIG.. 2 so that the trigger lever 70 can be pivoted to its unlocking position as shown in FIG. 9. Afterwards, the intermediate and drawer slide members 20, 18 can be easily moved to their fully retracted position shown in FIG. 10.

Figure 12:
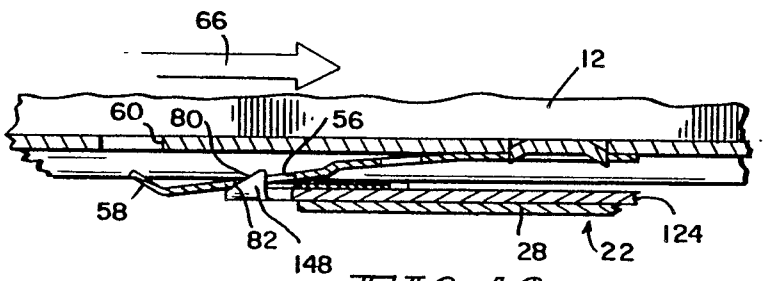
FIG. 12 is a sectional view taken along lines 12—12 of FIG. 11 showing engagement of the flexible strip and the cam faces of the locking lugs during movement of the drawer slide member toward is retracted position.
Figure 11:
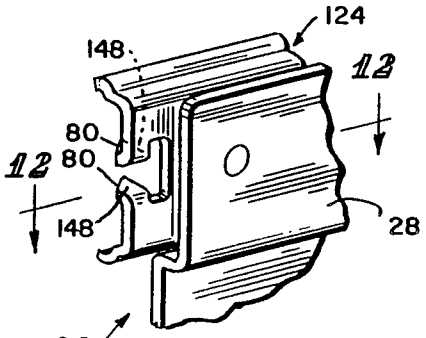
FIG. 11 is a perspective view of another embodiment of the invention wherein the locking lugs on the outer section of the intermediate slide member are formed to include cam faces.

Another embodiment of locking lugs 48 is illustrated in FIGS. 11 and 12. In this embodiment, locking lugs 148 on an outer section 124 is mounted on upper mounting plate 28 of support bracket 22 and are each provided with a cam ramp 80 as shown best in FIG. 12. Each cam ramp 80 is positioned to engage a portion of an inner edge 82 of flexible spring strip 50 in response to movement of drawer slide member 18 in a rearward direction 66 as shown in FIG. 12. Cam ramp 80 is oriented to urge the flexible spring strip 50 toward the drawer slide member 18 to eject locking lugs 148 on outer section 124 from engagement in the locking lug-receiving apertures 56 in response to continued movement of the drawer slide member 18 in rearward direction 66. Thus, the drawer slide member is movable from its release position to its retracted position without establishing a locked connection as in the case of the embodiment of FIGS. 1-10.

Although the invention has been described in detail with reference to certain preferred embodiments, variations and modifications exist within the scope and spirit of the invention as described and defined in the following claims.

What is claimed is:

1. An over and under telescoping slide assembly for supporting a movable drawer in a cabinet, the slide assembly comprising a stationary cabinet slide member for mounting on the cabinet, a drawer slide member for carrying the drawer, and an intermediate slide member including a support bracket slidably connected to the cabinet slide member and an outer section fixed to the support bracket form movement therewith, the outer section being formed to include channel means having a bottom wall and outwardly extending flanges for receiving the drawer slide member therein, an supporting means retained in the channel means for slidably supporting means drawer slide member in the channel means to permit sliding movement of the drawer slide member relative to the outer section from a retracted position in the outer section to a release position with the drawer slide member partially extending from the intermediate slide member, and where receiving means includes a flexible stop mounted to the bottom wall of said drawer slide member and biased outward from the bottom wall to lockingly engage a lug mounted on the outer section, with said receiving means being releasable to allow the drawer slide member and a drawer mounted thereon to be disconnected from the outer section of the intermediate slide member without removing the supporting means from the channel means in response to exit of the drawer slide member from the channel means at the release position.

2. The slide assembly of claim 1, further comprising a locking lug on the cabinet slide member, a trigger lever including a hook, means for pivotably coupling the trigger lever to the support bracket for movement between a locked position placing the hook in engagement with the locking lug to block movement of the intermediate slide member relative to the cabinet slide member from a partly extended position toward a fully retracted position and an unlocked position disengaging the hook and the locking lug to permit movement of the intermediate slide member toward the fully retracted position, and spring means for yieldably biasing the trigger lever to its locked position so that the hook is arranged to engage the locking lug upon movement of the intermediate slide member to the partly extended position, and wherein the trigger lever is positioned by the coupling means to lie in the path of the drawer slide member as it reciprocates in the channel means so that the drawer slide member is movable relative to the intermediate slide member to contact the trigger lever and pivot the trigger lever from its locked position to its unlocked position to permit the intermediate slide member to move relative to the cabinet slide member from its partly extended position toward its fully retracted position.

* * * * *